US008708207B2

(12) United States Patent
Wetzsteon

(10) Patent No.: US 8,708,207 B2
(45) Date of Patent: Apr. 29, 2014

(54) ADJUSTABLE CUSHIONING SYSTEM FOR SHOULDER STRAP

(75) Inventor: Paula J. Wetzsteon, Portland, OR (US)

(73) Assignee: Wilderness Comfort, PTL, LLC, Portland, OR (US)

( * ) Notice: Subject to any disclaimer, the term of this patent is extended or adjusted under 35 U.S.C. 154(b) by 164 days.

(21) Appl. No.: 13/328,323

(22) Filed: Dec. 16, 2011

(65) Prior Publication Data

US 2013/0153614 A1 Jun. 20, 2013

(51) Int. Cl.
*A41D 27/26* (2006.01)
*A45F 3/12* (2006.01)

(52) U.S. Cl.
USPC ..... 224/643; 224/264; 224/578; 2/268

(58) Field of Classification Search
USPC ..... 224/264, 578, 643; 2/24, 267–268, 2/459–462
See application file for complete search history.

(56) References Cited

U.S. PATENT DOCUMENTS

| | | | | | |
|---|---|---|---|---|---|
| 978,620 | A | * | 12/1910 | Murk | 2/460 |
| 1,174,757 | A | * | 3/1916 | Packer | 602/19 |
| 1,970,130 | A | * | 8/1934 | Dickenson | 2/462 |
| 2,689,350 | A | * | 9/1954 | Crawford | 2/460 |
| 3,144,657 | A | * | 8/1964 | Groot | 2/462 |
| 4,041,940 | A | * | 8/1977 | Frankel et al. | 602/26 |
| 4,125,904 | A | | 11/1978 | Levine | |
| 4,139,132 | A | | 2/1979 | Fairchild, Jr. | |
| 4,879,768 | A | | 11/1989 | McClees | |
| 4,887,318 | A | * | 12/1989 | Weinreb | 2/268 |
| 5,173,964 | A | * | 12/1992 | Ball et al. | 2/461 |
| 5,181,638 | A | | 1/1993 | McHale | |
| 6,267,280 | B1 | * | 7/2001 | Silagy | 224/264 |
| 6,460,746 | B1 | * | 10/2002 | Amram | 224/579 |
| 6,467,661 | B1 | * | 10/2002 | Mistretta et al. | 224/264 |
| 6,553,579 | B1 | * | 4/2003 | Gillen et al. | 2/268 |
| 7,725,958 | B1 | * | 6/2010 | Gilmore | 2/310 |
| 2004/0134602 | A1 | | 7/2004 | Falla | |
| 2006/0086232 | A1 | | 4/2006 | Peacock | |

FOREIGN PATENT DOCUMENTS

| | | | |
|---|---|---|---|
| FR | 2406402 | A * | 6/1979 |
| KR | 20030077506 | A | 10/2003 |

OTHER PUBLICATIONS

ISA Korea, International Search Report and Written Opinion of PCT/US2012/067437, WIPO, Mar. 27, 2013, 9 pages.
Rawlings Football Shoulder Pads Brute Junior, Rawlings Sporting Goods Company, Inc., Available Nov. 24, 2012, 1 page.
Ski Boots, Nordica, available at least as early as Jan. 1987.

* cited by examiner

*Primary Examiner* — Brian D Nash
*Assistant Examiner* — John Cogill
(74) *Attorney, Agent, or Firm* — Alleman Hall McCoy Russell & Tuttle LLP

(57) ABSTRACT

Embodiments are disclosed that relate to a removable and adjustable cushioning system for a shoulder strap. In one example, a base pad comprising cushioning material is contoured to conform to a person's shoulder. A plurality of fastener receivers are coupled to the base pad, and a fastener is removably coupled to at least one of the fastener receivers. The fastener is configured to engage the shoulder strap to removably secure the base pad to the shoulder strap.

19 Claims, 6 Drawing Sheets

Fig. 3
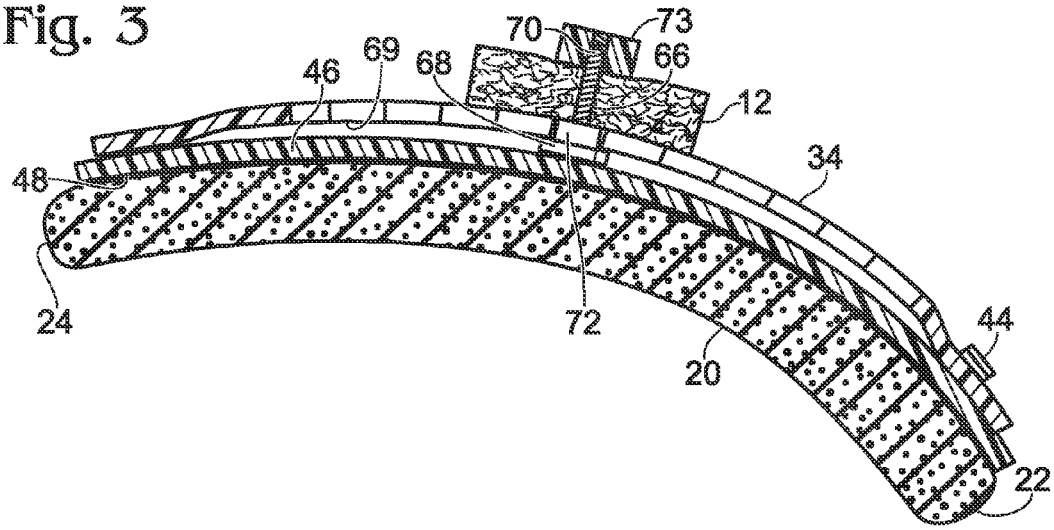
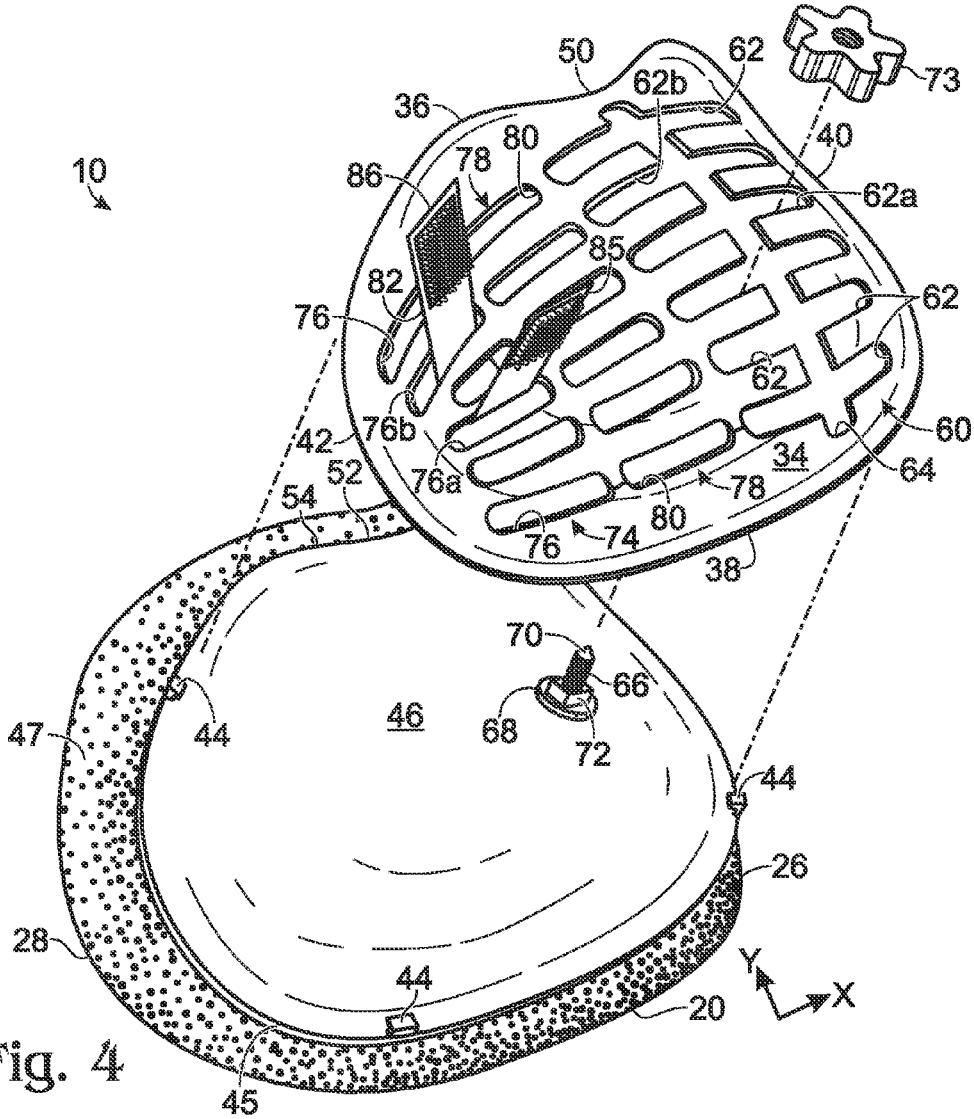
Fig. 4

TO Fig. 5B

ADJUSTABLE CUSHIONING SYSTEM FOR SHOULDER STRAP

BACKGROUND AND SUMMARY

Backpacks and other personal load-carrying equipment may utilize two shoulder straps for balancing and supporting a load across a person's shoulders. Some backpacks, such as those designed to carry heavier loads, may include features that reduce the load carried by the shoulders by transferring a portion of the load to the wearer's hips. Such features may include a hip belt that secures a lower portion of the backpack to the wearer's hips.

Even with hip belts or other similar features, shoulder discomfort may be experienced by a person carrying a load in a backpack. In some cases, backpack straps may also contribute to discomfort to the clavicle, muscles or other soft tissue in the area of the shoulders or upper chest. Particularly with heavier loads and on longer trips, a backpack shoulder strap may also impede circulation to and/or lymphatic return from a person's arms and hands, which may result in uncomfortable hand swelling.

When a person wearing a backpack experiences shoulder discomfort, the person may alter his or her natural walking or hiking posture to a less efficient or less comfortable posture in response to the discomfort. In some cases, a person may grab the shoulder straps and pull them away from the person's chest to temporarily relieve or redistribute the load on the person's shoulders. If the person is using hiking poles, the person may stop using the poles and allow them to dangle from straps around the person's wrists while the person pulls at the shoulder straps. These movements may lead to a less efficient and/or less stable walking or hiking posture.

To address hand swelling, a person may raise his or her arms overhead to encourage fluid drainage from the person's hands. This posture is also less-than-desirable for walking and hiking, and does not allow for the use of hiking poles. When experiencing shoulder discomfort, the person may also attempt to move the shoulder strap on the person's shoulder to an adjusted position. However, the strap will often shift back into its original, uncomfortable position on the shoulder as the person continues walking or hiking.

The inventor herein has recognized the above issues, as well as various solutions to address them. In one example, the above issues may be at least partly addressed by a removable and adjustable cushioning system for a shoulder strap. The removable and adjustable cushioning system may comprise a base pad that includes cushioning material and is contoured to conform to a person's shoulder. A plurality of fastener receivers are coupled to the base pad and a fastener is removably coupled to at least one of the fastener receivers. The fastener is configured to engage the shoulder strap and to removably secure the base pad to the shoulder strap.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

The present disclosure will be better understood from reading the following description of non-limiting embodiments, with reference to the attached drawings, wherein below:

FIG. 3 shows a cutaway view along line 3-3 of FIG. 2.

FIG. 4 shows an exploded view of the removable and adjustable cushioning system of FIG. 2.

The embodiments illustrated in FIGS. 1-4 and 6-9 are approximately to scale. It will be appreciated that other embodiments of the present disclosure may have proportions differing from those illustrated in FIGS. 1-4 and 6-9.

DETAILED DESCRIPTION

Figure 1:
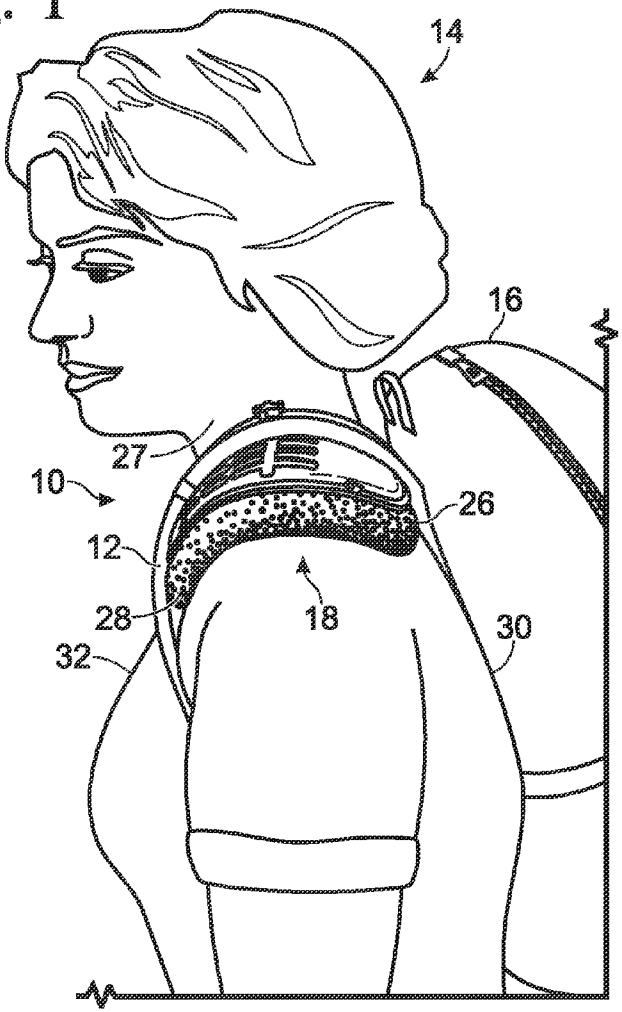
FIG. 1 shows a perspective view of a user wearing a backpack and an example embodiment of a removable and adjustable cushioning system for a shoulder strap.

FIGS. 1-4 illustrate a non-limiting example embodiment of a removable and adjustable cushioning system 10 for a shoulder strap 12. FIG. 1 shows a user 14 wearing a backpack 16 that includes a shoulder strap 12 with the cushioning system 10 between the shoulder strap and the user's shoulder 18. In one example, the shoulder strap 12 may include a fabric shell made of natural or synthetic fiber, with the shell containing a layer of fiber filling to provide a measure of cushioning. It will be appreciated that the backpack 16 may include a second shoulder strap (not shown) that extends over the other shoulder of the user 14. A second removable and adjustable cushioning system (not shown) may also be provided between the second shoulder strap and the user's other shoulder. It will also be appreciated that at least a portion of the load carried by the backpack 16 will be transferred through the shoulder strap 12 and cushioning system 10 to the shoulder 18 of the user 14. For ease of description, the cushioning system 10 will be described in relation to the shoulder strap 12 and user's shoulder 18 shown in FIG. 1.

Figure 2:
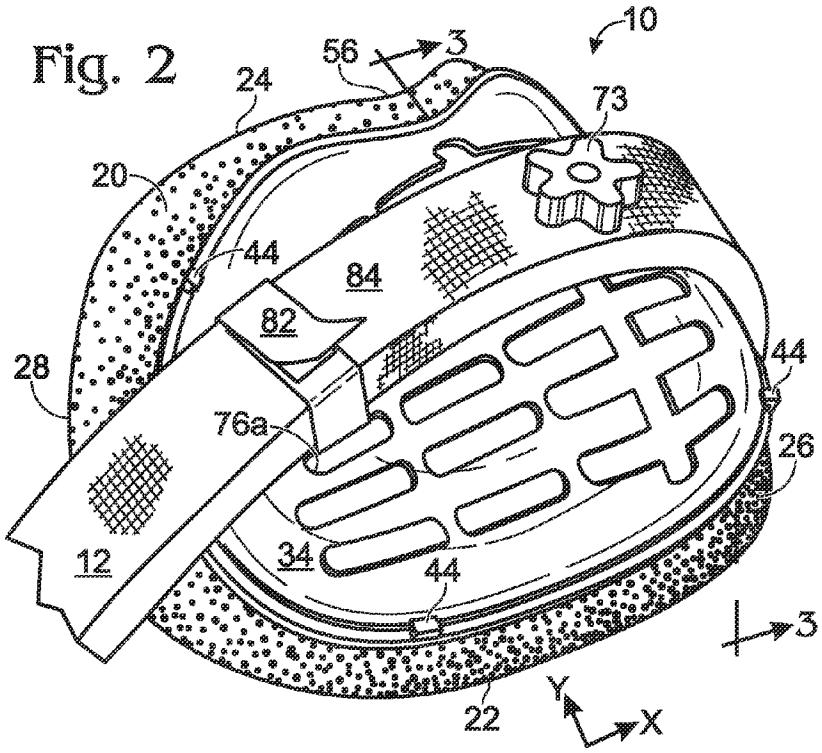
FIG. 2 shows a top view of the removable and adjustable cushioning system of FIG. 1.

With reference now also to FIGS. 2-4, the cushioning system 10 includes a base pad 20 that comprises cushioning material for supporting the shoulder strap 12 on the user's shoulder 18. The base pad 20 may include any suitable cushioning or shock-absorbing material including, but not limited to, fibrous padding, foam, gelatinous compounds, etc. As best seen in FIGS. 2 and 4, the base pad 20 may have a generally rounded rectangular footprint defined by a base pad shoulder side 22 and opposing base pad neck side 24, and by a base pad rear side 26 opposing base pad chest side 28.

As best seen in FIG. 3, the base pad 20 may have a convex curvature between the base pad shoulder side 22 and the base pad neck side 24, such that the base pad curves in a lateral direction generally from the user's shoulder 18 toward the user's neck 27 when mounted on the user's shoulder 18. Such lateral direction is generally indicated by the Y arrow in the X-Y axis shown in FIG. 2. The base pad 20 may also have a convex curvature from the base pad rear side 26 to the base pad chest side 28, such that the base pad curves in a longitudinal direction generally from the user's back 30 toward the user's chest 32 when mounted on the user's shoulder 18. Such longitudinal direction is generally indicated by the X arrow in the X-Y axis shown in FIG. 2.

With this configuration, the base pad 20 may be contoured to generally conform to the shoulder of a typical person, such as the shoulder 18 of the user 14 illustrated in FIG. 1. In this manner, a portion of the load carried in the backpack 16 may be distributed over the area of the base pad 20, which in turn distributes the load over a wider area of the user's shoulder 18 than with a typical shoulder strap. Such wider load distribution combined with the cushioning material of the base pad 20 may result in less localized pressure points and a more comfortable experience for the user. Further, and as described in more detail below, the position of the shoulder strap 12 on the base pad 20 may be conveniently adjusted and secured to provide a customized position and fit for an individual user. It will also be appreciated that other configurations, shapes and variations of the base pad 20 may be utilized within the scope of the present disclosure.

The removable and adjustable cushioning system 10 further includes a first positioning shell 34 that is removably coupled to the base pad 20. The first positioning shell 34 includes a first positioning shell neck side 36 and a first positioning shell shoulder side 38 that is substantially opposite to the first positioning shell neck side. The first positioning shell 34 may also include a positioning shell back side 40 and a positioning shell chest side 42.

The first positioning shell 34 may be removably coupled to the base pad 20 via the base shell 46 and flexible retention clips 44. As shown in FIGS. 3 and 4, the flexible retention clips 44 may be located along a periphery 45 of a base shell 46 that is affixed to the base pad 20. When installed, the first positioning shell 34 may be secured to the base shell 46 by each of the flexible retention clips 44 extending over a peripheral portion of the first positioning shell to retain the first positioning shell on the base shell. The first positioning shell 34 may also be conveniently removed from the base shell 46 by bending the retention clips 44 away from the peripheral portion of the positioning shell. It will be appreciated that any other type of suitable fastener that may removably couple the first positioning shell 34 to the base pad 20 via the base shell 46 may also be used.

As best seen in FIGS. 3 and 4, the base shell 46 may have a contour that substantially matches the contour of the base pad 20, such that the base shell lies substantially flat along an upper surface 48 of the base pad 20. With reference to FIG. 4, the base shell 46 may have an overall shape that substantially matches the shape of the base pad 20 while being slightly smaller than the base pad. In this manner, an outer peripheral portion 47 of the base pad 20 may extend beyond the periphery 45 of the base shell 46. The base shell 46 may comprise plastic, metal, composite, or other suitable material. The base shell 46 may be affixed to the base pad 20 by adhesive, mechanical fastener or any other suitable method.

In other examples, the flexible clips 44 may be affixed directly to an upper surface of the base pad 20. In these examples, a base shell may not be used. It will also be appreciated that any other type of suitable fastener that may removably couple the first positioning shell 34 to the base pad 20 may also be used.

The first positioning shell 34 may have a contour and overall shape that substantially matches the contour and overall shape of the base shell 46, such that when the first positioning shell is coupled to the base shell 46, the first positioning shell 34 generally follows the contour and curvature of the base shell 46 and base pad 20. Like the base shell 46, the first positioning shell 34 may be formed from plastic, metal, composite, or other any suitable material. The first positioning shell 34 may include a positioning shell neck notch 50 that is formed in the first positioning shell neck side 36. Similarly, the base shell 46 may include a base shell neck notch 52 that is formed in a base shell neck side 54. The base pad 20 may also include a base pad neck notch 56 that is formed in the base pad neck side 24. As best seen in FIGS. 2 and 4, the base pad neck notch 56 may be located substantially adjacent to the first positioning shell neck notch 50 and the base shell neck notch 52. Advantageously, and with reference also to FIG. 1, when the cushioning system 10 is positioned on a user's shoulder 18, the base pad neck notch 56, base shell neck notch 52 and positioning shell neck notch 50 create additional clearance adjacent to the neck 27 of the user 14 to provide freedom of movement and to avoid chafing or rubbing against the user's neck.

The first positioning shell 34 includes a plurality of fastener receivers that may receive one or more removable fasteners. As explained in more detail below, the fasteners may be configured to engage the shoulder strap 12 to removably secure the base pad 20 to the shoulder strap. Additionally, the fastener receivers are distributed about the first positioning shell 34 to enable a user to customize the placement and fit of a shoulder strap 12 on the cushioning system 10.

With reference to FIG. 4, the fastener receivers may include a first row 60 of receiving slots 62. The first row 60 of receiving slots 62 extends in a lateral direction with respect to the first positioning shell 34, and generally between the first positioning shell shoulder side 38 and the first positioning shell neck side 36. Each of the receiving slots 62 extends in a longitudinal direction with respect to the first positioning shell 34. A position adjustment slot 64 intersects each of the receiving slots 62 and also extends in a lateral direction with respect to the first positioning shell 34, and generally between the first positioning shell shoulder side 38 and the first positioning shell neck side 36. Advantageously, and as explained in more detail below, the position adjustment slot 64 may allow a user to conveniently adjust the positioning of a shoulder strap 12 on the cushioning system 10.

With reference now also to FIG. 3, in this example the fastener may comprise a threaded post 66 that includes a proximal end 68 that is positioned between a lower surface 69 of the first positioning shell 34 and the base shell 46 when installed. The threaded post 66 also includes a pointed distal end 70 that is configured to extend upwardly through one of the receiving slots 62 and/or through the position adjustment slot 64, and to protrude through the shoulder strap 12 when installed. The proximal end 68 of the threaded post 66 may be generally circular in shape and may have a diameter that is greater than a lateral width of each of the receiving slots 62. In this manner, when the post 66 extends through a receiving slot 62, the proximal end 68 abuts the lower surface 69 of the first positioning shell 34 and retains the post within the receiving slot 62. Additionally, and as best seen in FIG. 4, the post 66 may also include a raised square portion 72 adjacent to the proximal end 68. The raised square portion 72 may be configured to extend into a receiving slot 62 and to constrain the post 66 from substantial rotation within the slot. Additionally, the raised square portion 72 may be configured to allow the post to move longitudinally within a receiving slot 62 and laterally through the position adjustment slot 64.

A threaded cap 73 may be removably received by the distal end 70 and threaded portion of the post 66 to removably secure the shoulder strap 12 to the first positioning shell 34 and base pad 20. Additionally, and as explained in more detail below, the position adjustment slot 64 enables the threaded post 66 to be moved from a first receiving slot, for example 62*a*, to a second receiving slot, for example 62*b* while the threaded cap 73 remains in engagement with the post. Advantageously, in this manner the user 14 may conveniently adjust and/or reposition the cushioning system 10 on the user's shoulder 18 with the cap 73 remaining in engagement with the threaded post 66.

The first positioning shell 34 may also include one or more additional rows of receiving slots for receiving an additional fastening member that may removably secure the first positioning shell 34 and the base pad 20 to the shoulder strap 12. With reference to FIGS. 2 and 4, in one example the first positioning shell 34 may include a second row 74 of receiving slots 76 that is spaced in a longitudinal direction from the first row 60 of receiving slots 62. The first positioning shell 34 may also include a third row 78 of receiving slots 80 positioned between the first row 60 and the second row 74. As shown in FIGS. 2 and 4, a retaining strap 82 may be configured to extend under the first positioning shell 34, upwardly through receiving slots 76*a* and 76*b* in the second row 74, and over an upper surface 84 of the shoulder strap 12 to removably secure the first positioning shell 34 and the base pad 20 to the shoulder strap.

The retaining strap 82 includes a first end 85 and a second end 86 that may be removably affixed to one another. In the example shown in FIGS. 2 and 4, the retaining strap 82 includes hook and loop fastener strips attached to opposing surfaces of the first end 85 and second end 86 of the strap to allow one end to be removably affixed to the other. It will be appreciated that any other suitable removable fastener may be used in place of the hook and loop fasteners and/or the retaining strap 82 including, but not limited to, elastomeric cords, cinch cords, buckles, clips, etc. In this manner, with the retaining strap 82 spaced in a longitudinal direction from the post 66 and first row 60 of receiving slots 62, the cushioning system 10 may provide two longitudinally spaced locations for securing the shoulder strap 12 to the first positioning shell 34 and base pad 20. Advantageously, these two spaced apart securing locations maintain the shoulder strap 12 in a desired position through a range of potential motions and/or movements of the user's shoulder 18, varying postures of the user 14, etc. Additionally, and as described in more detail below, the adjustability of the positions of the post 66 and retaining strap 82 enable the user 14 to conveniently customize the position and fit of the cushioning system 10 on the user's shoulder 18.

Figure 5A:
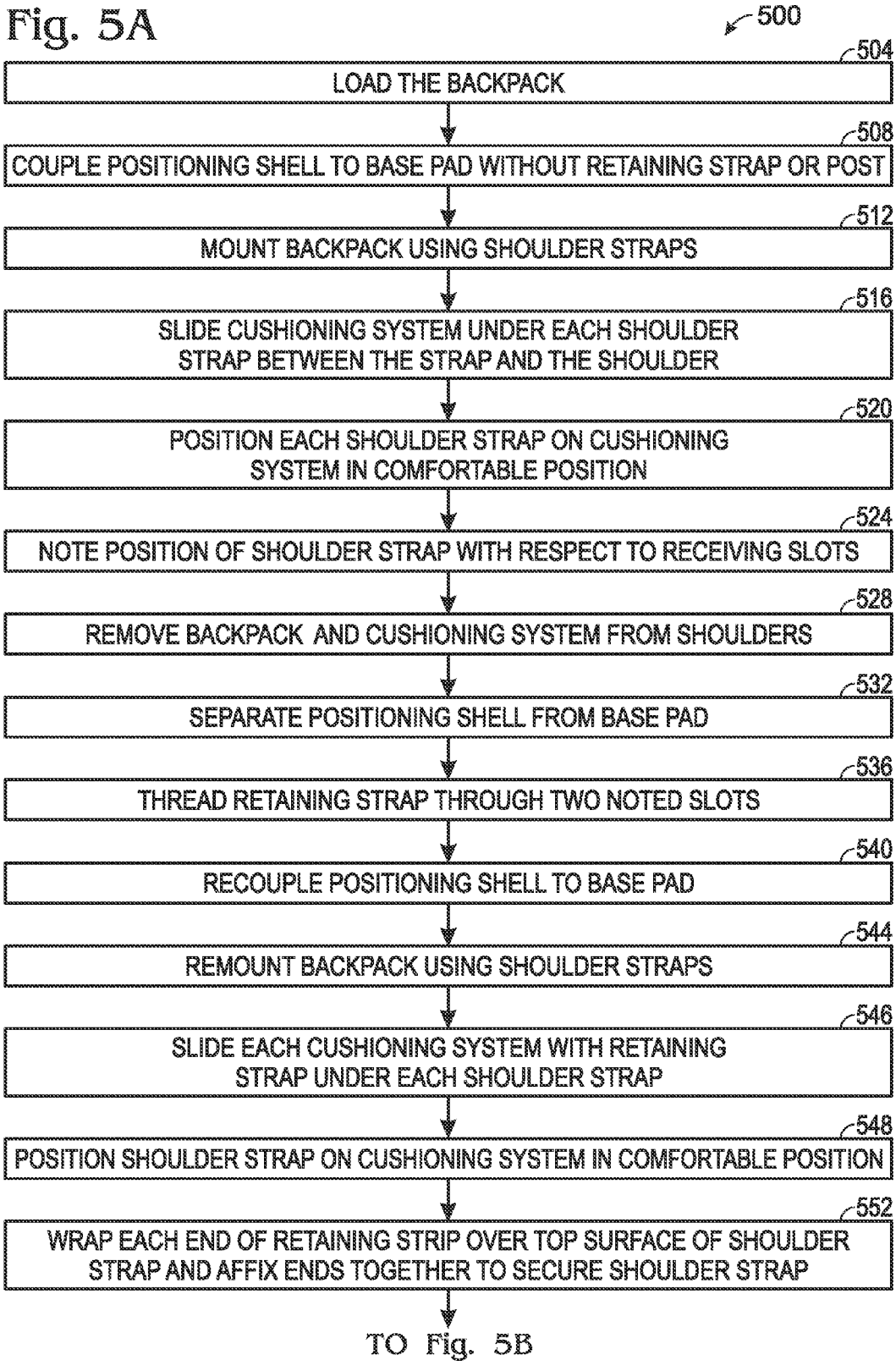
FIGS. 5A and 5B show a flow chart of an example embodiment of a method of positioning a shoulder strap on a removable and adjustable cushioning system.

With reference now to FIG. 5A, an example embodiment of a method 500 for positioning two shoulder straps on two removable and adjustable cushioning systems is provided. In one example, the method 500 may be performed using the features and components of the example embodiment of the cushioning system 10 described above and shown in FIGS. 1-4. For ease of description, the method 500 will be described with respect to user 14, and will generally discuss positioning one of the two shoulder straps on one of the two cushioning systems 10.

At 504 the method 500 may include loading the backpack 16. In one example, the backpack may be loaded to reflect a typical weight and load distribution used by the user 14. At 508, for each of the two cushioning systems 10, the method 500 may include coupling the first positioning shell 34 (without the retaining strap 82 or threaded post 66) to the base pad 20 using the retaining clips 44. At 512 the method 500 may include mounting the backpack 16 on the back 30 of the user 14 with both shoulder straps supporting the backpack on the user's shoulders. At 516 the method 500 may include sliding one cushioning system 10 under one of the shoulder straps, such as shoulder strap 12, and the other cushioning system under the other shoulder strap to position the cushioning systems between the shoulder straps and the user's shoulders. At 520 the method 500 may then include positioning each shoulder strap on the corresponding cushioning system 10 in a comfortable position for the user 14.

Once each shoulder strap is located in a comfortable position on the adjacent cushioning system 10, for each cushioning system the method 500 includes at 524 noting the position of the shoulder strap with respect to the receiving slots in the positioning shell 34. In one example, on each side of the shoulder strap 12 the nearest partially or fully unobstructed receiving slot 76 in the second row 74 of receiving slots may be noted. At 528 the method 500 may include removing the two shoulder straps, backpack 16 and two cushioning systems 10 from the user's shoulders.

At 532, for each cushioning system 10 the method 500 may include separating the first positioning shell 34 from the base pad 20 and base shell 46. At 536 the method 500 may include threading the retaining strap 82 through the two receiving slots 76 noted above, such that the first end 85 and second end 86 of the retaining strap extend upwardly through the receiving slots as illustrated in FIG. 4. With the retaining strap 82 threaded, at 540 the method 500 may include recoupling the first positioning shell 34 to the base pad 20 using the retaining clips 44.

At 544 the method 500 may include remounting the backpack 16 on the back 30 of the user 14 with both shoulder straps supporting the backpack on the user's shoulders. At 546 the method 500 may include sliding each cushioning system 10 including the threaded retaining strap 82 under each shoulder strap to position the cushioning system between the shoulder strap and the user's shoulder 18. At 548 the method 500 may then include positioning the shoulder strap 12 on the cushioning system 10 in a comfortable position for the user 14. At 552, for each of the cushioning systems 10, the method 500 may include wrapping the first end 85 and second end 86 of the retaining strap 82 over the upper surface 84 of the shoulder strap 12 and affixing the first end to the second end to secure the base pad 20 to the shoulder strap.

In one example, if the first end 85 and second end 86 are not positioned properly to wrap over and secure the shoulder strap in a comfortable position, the backpack, shoulder straps and cushioning systems may be removed from the user's shoulders, the positioning plate 34 separated from the base pad 20, and the retaining strap 82 may be rethreaded through one or more different receiving slots 76 that better position the retaining strap to secure the shoulder strap in a comfortable position for the user 14.

Figure 5B:
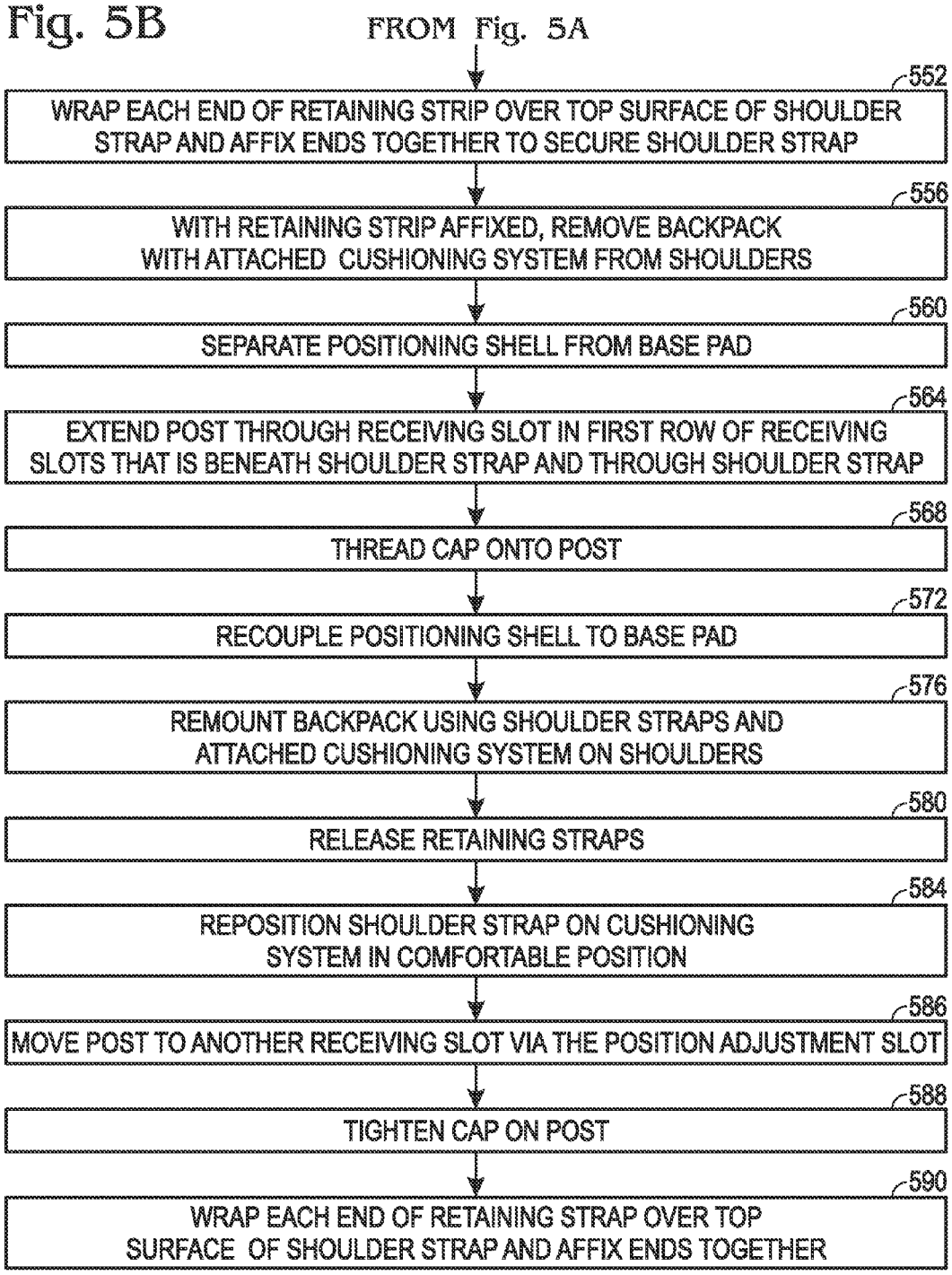

With reference now to FIG. 5B, at 556 and with the retaining straps remaining affixed around the shoulder straps, the method 500 may include removing the shoulder straps and attached cushioning systems 10 from the user's shoulders. At 560, for each cushioning system the method 500 may include separating the first positioning shell 34 from the base pad 20. At 564 the method 500 may include extending a threaded post 66 through a receiving slot 62 in the first row 60 of receiving slots, with the selected receiving slot 62 located beneath the shoulder strap 12. At 564 the method 500 also includes extending the post 66 through the shoulder strap 12, such that the distal end 70 of the post extends above the shoulder strap. At 568 the method 500 may include threading the cap 73 onto the post 66 to secure the shoulder strap 12 to the first positioning shell 34.

At 572 the method 500 may include recoupling the first positioning shell 34 to the base pad 20. At 576 the method may include remounting the backpack 16 with the shoulder straps and the attached cushioning systems 10 on the user's shoulders. At 580 the method 500 may include releasing the retaining straps 82 from securing the shoulder straps 12 such that only the posts 66 and caps 73 retain the shoulder straps to the base pads 20. At 584 the method 500 may include repositioning the shoulder straps on the cushioning system in a more comfortable position, if necessary. In one example, at 586 such repositioning may include moving the post 66 from a current receiving slot, such as receiving slot 62*a*, to a different receiving slot, such as receiving slot 62*b*, via the position adjustment slot 64. Advantageously, in this manner the shoulder strap 12 may be conveniently repositioned to a more comfortable position while the first positioning shell 34 remains coupled to the base pad 20, and the post 66 and cap 73 remain engaged with the shoulder strap.

At 588, once the shoulder strap 12 is in a comfortable position, the method 500 may include tightening the cap 73 on the post 66 by an additional amount to further secure the shoulder strap between the cap and the first positioning shell 34, and thereby further secure the shoulder strap to the base pad 20. At 590, for each of the cushioning systems 10 the method 500 may include wrapping the first end 85 and second end 86 of the retaining strap 82 over the top surface of the shoulder strap 12 and affixing the first end to the second end to secure the base pad 20 to the shoulder strap.

With reference now to FIGS. 6-9, descriptions of removable and adjustable cushioning systems according to other example embodiments of the present disclosure will now be provided. As described in more detail below, each of these embodiments may utilize a positioning shell that may be removably coupled to a base pad, such as base pad 20, in a manner similar to the example embodiment described above and shown in FIGS. 1-4. In one example, each of the positioning shells may be removably coupled to the base pad 20 and base shell 46 by flexible retention clips, such as the retention clips 44 described above. Thus, it will be appreciated that the positioning shells and associated fasteners and fastener receivers described below and shown in FIGS. 6-9 may be utilized with the base pad 20, base shell 46 and flexible retention clips 44 as described above and shown in FIGS. 2-4. Accordingly, for ease of description, the positioning shells shown in FIGS. 6-9 are described below in relation to the base pad 20, base shell 46 and flexible retention clips 44.

Additionally, the positioning shells shown in FIGS. 6-9 include different examples of fastener receivers and fasteners. In this manner, a removable and adjustable cushioning system having interchangeable positioning shells may also be provided. Advantageously, a user may substitute a first positioning shell having a first type of fastener receiver and corresponding fastener for a second positioning shell having a second type of fastener receiver and corresponding fastener. This may allow a user to select a particular positioning shell and fastener/fastener receiver combination that best fits and/or functions with a particular shoulder strap.

Figure 6:
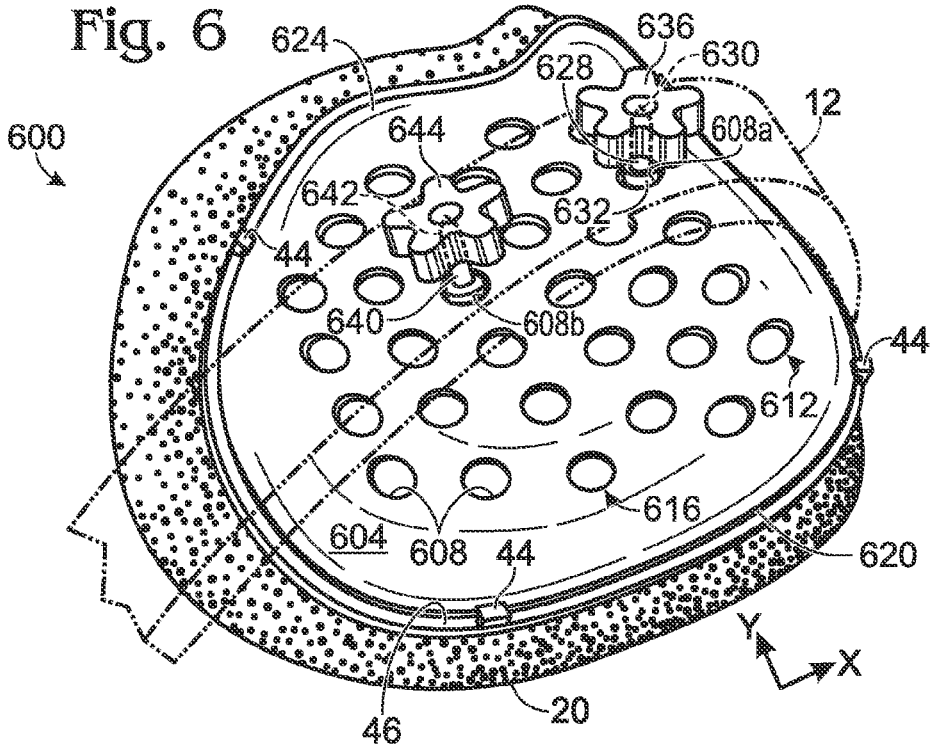
FIG. 6 shows a top view of another example embodiment of a removable and adjustable cushioning system.

Turning now to FIG. 6, another non-limiting example embodiment of a removable and adjustable cushioning system 600 for a shoulder strap 12 will now be described. The cushioning system 600 may include a second positioning shell 604 that is removably coupled to the base shell 46 and base pad 20 by flexible retention clips 44.

The second positioning shell 604 includes multiple rows of fastener receivers in the form of apertures 608, such as first row 612 and fourth row 616. Each of the rows of apertures 608 extends in a lateral direction with respect to the second positioning shell 604, and generally between a second positioning shell shoulder side 620 and a second positioning shell neck side 624. In one example, the apertures 608 may be substantially circular and may have substantially the same diameter. In other examples, the apertures may be substantially square in shape.

A first aperture 608*a* located in first row 612 may receive a first threaded post 628 that includes a proximal end 632. The first threaded post 628 also includes a pointed distal 630 end that is configured to extend upwardly through the first aperture 608*a* and to protrude through the shoulder strap 12 when installed. The proximal end 632 may be generally circular in shape and may have a diameter that is greater than a diameter of each of the apertures 608. In this manner, when the first threaded post 628 extends upwardly through the first aperture 608*a*, the proximal end 632 abuts a lower surface of the second positioning shell 604 and retains the post within the aperture. A first threaded cap 636 may be removably received by the distal end 630 and threaded portion of the first threaded post 628 to removably secure the shoulder strap 12 to the second positioning shell 604 and base pad 20.

As shown in FIG. 6, a second threaded post 640 may be received by a second aperture 608*b* that is located in fourth row 616 and is longitudinally aligned with the first aperture 608*a* under the shoulder strap 12. Like the first threaded post 628, the second threaded post 640 also includes a pointed distal end 642 that is configured to extend upwardly through the second aperture 608*b* and to protrude through the shoulder strap 12 when installed. A second threaded cap 644 may be removably received by the distal end and threaded portion of the second threaded post 640 to further removably secure the shoulder strap 12 to the second positioning shell 604 and base pad 20.

Using this example embodiment of a removable and adjustable cushioning system 600, a user may adjustably position and secure a shoulder strap on the cushioning system using an iterative fitting process that may include one or more of the steps described above and shown in FIGS. 5A and 5B.

Figure 7:
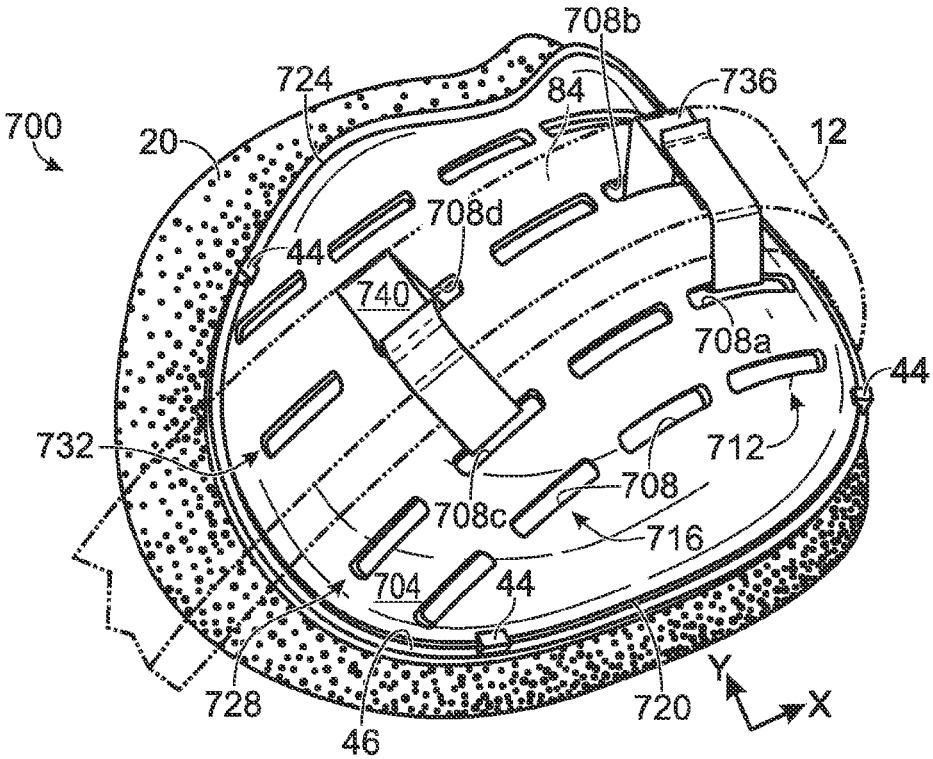
FIG. 7 shows a top view of another example embodiment of a removable and adjustable cushioning system.

With reference now to FIG. 7, another non-limiting example embodiment of a removable and adjustable cushioning system 700 for a shoulder strap 12 will now be described. The cushioning system 700 may include a third positioning shell 704 that is removably coupled to the base shell 46 and base pad 20 by flexible retention clips 44.

The third positioning shell 704 includes multiple rows of fastener receivers in the form of receiving slots 708, such as first row 712 and third row 716. Each of the rows of receiving slots 708 extends in a lateral direction with respect to the third positioning shell 704, and generally between a third positioning shell shoulder side 720 and a third positioning shell neck side 724. In one example, each of the receiving slots 708 may extend in a longitudinal direction along the third positioning shell 704. Additionally, the receiving slots 708 may also be arranged in multiple columns, such as second column 728 and third column 732, that each extends in a longitudinal direction along the third positioning shell 704. In this manner, receiving slots 708 in adjacent columns may be substantially parallel to one another.

A first retaining strap 736 may be configured to extend under the third positioning shell 704, upwardly through receiving slots 708*a* and 708*b* in the first row 712, and over an upper surface 84 of the shoulder strap 12 to removably secure the shoulder strap 12 to the third positioning shell 704 and the base pad 20. The first retaining strap 736 includes a first end and a second end that may be removably affixed to one another in a manner similar to the retaining strap 82 described above. For example, the first retaining strap 736 may include hook and loop fastener strips attached to opposing surfaces of the first end and second end of the strap to allow one end to be removably affixed to the other. It will be appreciated that any other suitable removable fastener may be used in place of the hook and loop fasteners and/or the first retaining strap 736.

A second retaining strap 740 may be configured to extend under the third positioning shell 704, upwardly through receiving slots 708*c* and 708*d* in the third row 716, and over an upper surface 84 of the shoulder strap 12 to removably secure the shoulder strap 12 to the third positioning shell 704 and the base pad 20. The third receiving slot 708*c* may be located in the second column 728 that also includes the first receiving slot 708*a*. The fourth receiving slot 708*d* may be located in the third column 732 that also includes the second receiving slot 708*b*.

The second retaining strap 740 includes a first end and a second end that may be removably affixed to one another in a manner similar to the retaining strap 82 described above. For example, the second retaining strap 740 may include hook and loop fastener strips attached to opposing surfaces of the first end and second end of the strap to allow one end to be removably affixed to the other. It will be appreciated that any other suitable removable fastener may be used in place of the hook and loop fasteners and/or the second retaining strap 740. In this manner, with the second retaining strap 740 spaced in a longitudinal direction from the first retaining strap 736, the cushioning system 700 may secure the shoulder strap 12 to the third positioning shell 704 and base pad 20 at two spaced apart locations along the positioning shell.

Using this example embodiment of a removable and adjustable cushioning system 700, a user may adjustably position and secure a shoulder strap on the cushioning system using an iterative fitting process that may include one or more of the steps described above and shown in FIGS. 5A and 5B.

Figure 8:
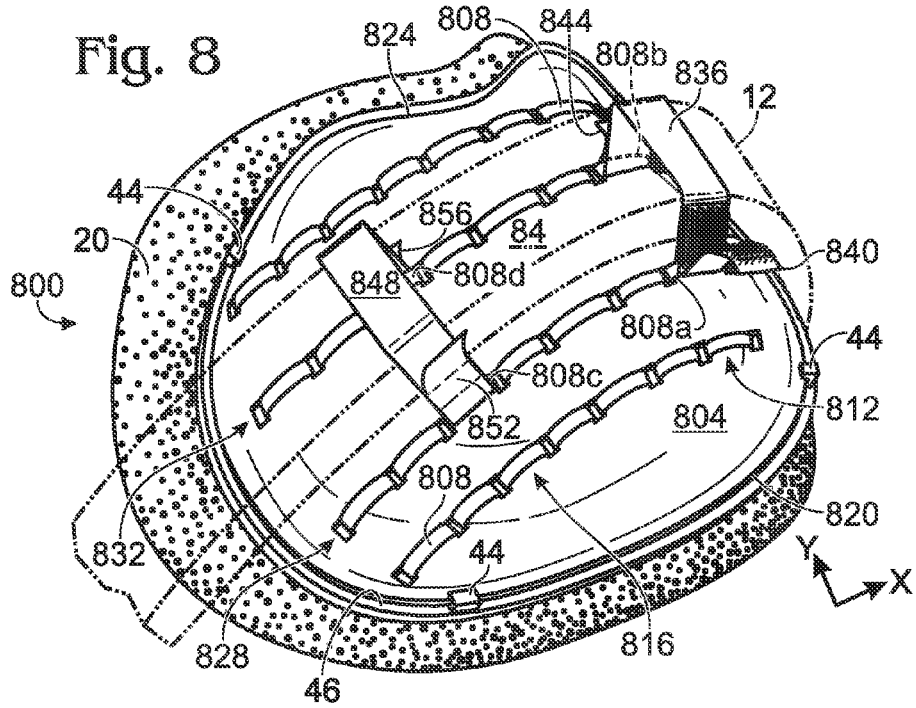
FIG. 8 shows a top view of another example embodiment of a removable and adjustable cushioning system.

With reference now to FIG. 8, another non-limiting example embodiment of a removable and adjustable cushioning system 800 for a shoulder strap 12 will now be described. The cushioning system 800 may include a fourth positioning shell 804 that is removably coupled to the base shell 46 and base pad 20 by flexible retention clips 44. The fourth positioning shell 804 includes multiple rows of fastener receivers in the form of anchor loops 808, such as first row 812 and fifth row 816. Each of the rows of anchor loops 808 extends in a lateral direction with respect to the fourth positioning shell 804, and generally between a fourth positioning shell shoulder side 820 and a fourth positioning shell neck side 824. In one example, each of the anchor loops 808 may extend in a longitudinal direction along the fourth positioning shell 804. Additionally, the anchor loops 808 may also be arranged in multiple columns, such as second column 828 and third column 832, that each extends in a longitudinal direction along the fourth positioning shell 804. In this manner, anchor loops 808 in adjacent columns may be substantially parallel to one another.

A first retaining strap 836 may be configured to extend through a first anchor loop 808*a*, over an upper surface 84 of the shoulder strap 12, and through a second anchor loop 808*b* to removably secure the shoulder strap to the fourth positioning shell 804 and the base pad 20. In this example, after passing through the first anchor loop 808*a*, a first end 840 of the first retaining strap 836 may double back and be removably secured to an opposing surface of the retaining strap by, for example, hook and loop fastener strips attached to a surface of the first end 840 and the opposing surface. In a similar manner, after passing through the second anchor loop 808*b*, a second end 844 of the first retaining strap 836 may double back and be removably secured to an opposing surface of the retaining strap by, for example, hook and loop fastener strips attached to a surface of the second end 844 and the opposing surface. It will be appreciated that any other suitable removable fastener may be used in place of the hook and loop fasteners and/or the first retaining strap 836.

A second retaining strap 848 may be configured to extend through a third anchor loop 808*c*, over an upper surface 84 of the shoulder strap 12, and through a fourth anchor loop 808*d* to removably secure the shoulder strap to the fourth positioning shell 804 and the base pad 20. The third anchor loop 808*c* may be located in the second column 828 that also includes the first anchor loop 808*a*. The fourth anchor loop 808*d* may be located in the third column 832 that also includes the second anchor loop 808*b*.

Like the first retaining strap 848, a first end 852 of the second retaining strap 836 may double back and be removably secured to an opposing surface of the retaining strap by, for example, hook and loop fastener strips attached to a surface of the first end 852 and the opposing surface. In a similar manner, after passing through the fourth anchor loop 808*d*, a second end 856 of the second retaining strap 848 may double back and be removably secured to an opposing surface of the retaining strap by, for example, hook and loop fastener strips.

In this manner, with the second retaining strap 848 spaced in a longitudinal direction from the first retaining strap 836, the cushioning system 800 may secure the shoulder strap 12 to the fourth positioning shell 804 and base pad 20 at two spaced apart locations along the positioning shell. It will also be appreciated that in other examples, the anchor loops 808 may be attached to the base shell 46 or an upper surface of the base pad 20, thereby eliminating the fourth positioning shell 804.

Using this example embodiment of a removable and adjustable cushioning system 800, a user may adjustably position and secure a shoulder strap on the cushioning system using an iterative fitting process that may include one or more of the steps described above and shown in FIGS. 5A and 5B.

Figure 9:
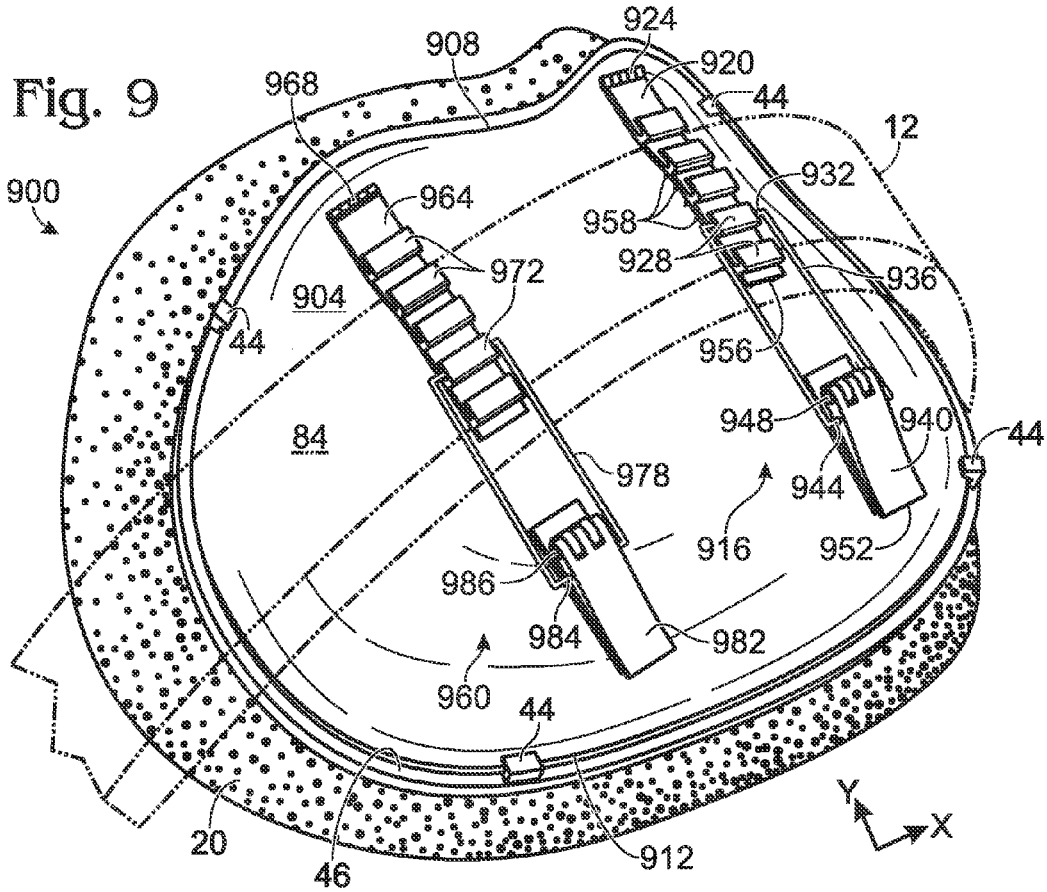
FIG. 9 shows a top view of another example embodiment of a removable and adjustable cushioning system.

With reference now to FIG. 9, another non-limiting example embodiment of a removable and adjustable cushioning system 900 for a shoulder strap 12 will now be described. The cushioning system 900 may include a fifth positioning shell 904 that is removably coupled to the base shell 46 and base pad 20 by flexible retention clips 44. The fifth positioning shell 904 may include a fifth positioning shell neck side 908 and a fifth positioning shell shoulder side 912. A first fastening assembly 916 may be coupled to the fifth positioning shell 904 to selectively engage the shoulder strap 12 and removably secure the fifth positioning shell and the base pad 20 to the shoulder strap. In one example, the first fastening assembly 916 may include a first arm 920 that is rotatably coupled to the fifth positioning shell 904 by a first hinge 924. As described in more detail below, the first arm 920 may rotate about the first hinge 924 to selectively engage and release the shoulder strap 12.

The first arm 920 may include a plurality of hooks 928 that are configured to receive a first cross member 932 of a first bale 936. The first bale 936 may be rotatably coupled to a first lever 940 at a first connection point 944. The first bale 936 may comprise a loop formed from wire, elastomeric material, or any other suitable material. The first lever may be rotatably coupled to the fifth positioning shell 904 such that the first lever rotates about a first axis of rotation 948 that is spaced from the first connection point 944 of the first bale 936. In this manner, as the first lever 940 rotates from a closed position as shown in FIG. 9 to an open position in which a distal end 952 of the first lever points toward the fifth positioning shell neck side 908, the first bale 936 and first cross member 932 are translated in a lateral direction toward the fifth positioning shell neck side. Similarly, as the first lever 940 rotates from an open position to the closed position shown in FIG. 9, the first bale 936 and first cross member 932 are translated in a lateral direction away from the fifth positioning shell neck side.

In one example, the shoulder strap 12 may be positioned beneath first arm 920, the first cross member 932 may be captured by one of the plurality of hooks 928, and the first lever 940 may be in an open position, thereby exerting limited downward pressure on the shoulder strap. In this position, a distal end 956 of the first arm 920 may be vertically spaced from the fifth positioning shell 904 by a first distance, with the shoulder strap 12 being in a substantially uncompressed state beneath the first arm. As the first lever 940 is rotated from an open position to a closed position, the first arm 920 rotates downwardly about the first hinge 924 to compress and secure the shoulder strap 12 against the fifth positioning shell 904, such that the distal end 956 of the first arm 920 is spaced from the fifth positioning shell by a second distance less than the first distance. The first arm 920 may also include a plurality of downwardly projecting teeth 958 that may grip the material of the shoulder strap 12 to prevent the shoulder strap from slipping relative to the first arm.

A second fastening assembly 960 may be laterally spaced from the first fastening assembly 916. The second fastening assembly 960 may also be coupled to the fifth positioning shell 904 to selectively engage the shoulder strap 12 and removably secure the fifth positioning shell and the base pad 20 to the shoulder strap. In one example, the second fastening assembly 960 may include a second arm 964 that is rotatably coupled to the fifth positioning shell 904 by a second hinge 968. The second arm 964 may include a plurality of hooks 972 that are configured to receive a second cross member 974 of a second bale 978. The second bale 978 may be rotatably coupled to a second lever 982 at a second connection point 984. The second lever 982 may be rotatably coupled to the fifth positioning shell 904 such that the second lever rotates about a second axis of rotation 986 that is spaced from the second connection point 984 of the second bale 978. The second arm 964 may also include a plurality of downwardly projecting teeth (not shown) that may grip the material of the shoulder strap 12 to prevent the shoulder strap from slipping relative to the second arm.

It will be appreciated that the second fastening assembly 960 may operate to selectively engage and release the shoulder strap 12 in a manner similar to the first fastening assembly 916 discussed above. In this manner, with the second fastening assembly 960 spaced in a longitudinal direction from the first fastening assembly 916, the cushioning system 900 may secure the shoulder strap 12 to the fifth positioning shell 904 and base pad 20 at two spaced apart locations along the positioning shell. Advantageously, a user may conveniently position and secure a shoulder strap 12 on the cushioning system 900 by selectively engaging and releasing the shoulder strap 12 using the first fastening assembly 916 and second fastening assembly 960. It will also be appreciated that in other examples, the first and second fastening assemblies 916, 960 may be attached to the base shell 46 or to an upper surface of the base pad 20, thereby eliminating the fifth positioning shell 904. It will also be appreciated that in other examples, a single fastening assembly similar to the first or second fastening assemblies 916, 960 may be utilized.

The removable and adjustable cushioning systems and methods described above may provide a more comfortable load-carrying experience for a user as compared to using a typical shoulder strap. Distributing a portion of the load over the area of the cushioned base pad 20 may result in less localized pressure points and a more comfortable experience for the user. A position of the shoulder strap 12 on the base pad 20 may also be conveniently adjusted and secured to provide a customized fit for an individual user.

It is to be understood that the configurations and/or approaches described herein are exemplary in nature, and that these specific embodiments or examples are not to be considered in a limiting sense, because numerous variations are possible. The specific routines or methods described herein may represent one or more of any number of strategies for customizing a position of and securing a removable and adjustable cushioning system according to the present disclosure. As such, various steps illustrated may be performed in the sequence illustrated, in other sequences, in parallel, or in some cases omitted. Likewise, the order of the above-described steps may be changed.

The subject matter of the present disclosure includes all novel and nonobvious combinations and sub-combinations of the various processes, systems and configurations, and other features, functions, acts, and/or properties disclosed herein, as well as any and all equivalents thereof.

The following claims particularly point out certain combinations and sub-combinations regarded as novel and nonobvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A removable and adjustable cushioning system for a shoulder strap, the removable and adjustable cushioning system comprising:

a base pad comprising cushioning material and being contoured to conform to a person's shoulder;

a base shell forming a hard outer covering that is permanently affixed to an upper surface of the base pad;

a plurality of fastener receivers coupled to the base pad via the base shell; and a fastener removably coupled to at least one of the fastener receivers, the fastener configured to engage the shoulder strap to removably secure the base pad to the shoulder strap, wherein the fastener is a first fastener and the at least one of the fastener receivers is a first fastener receiver, further comprising a second fastener removably coupled to a second fastener receiver that is spaced from the first fastener receiver, the second fastener configured to removably secure the base pad to the shoulder strap.

2. The removable and adjustable cushioning system of claim 1, wherein the plurality of fastener receivers comprises a plurality of anchor loops, the first fastener receiver comprises a first anchor loop, and the first fastener comprises a retaining strap, further comprising:

a second anchor loop positioned between the first anchor loop and a base pad neck side, wherein the retaining strap, is configured to extend through the first anchor loop, over an upper surface of the shoulder strap, and through the second anchor loop to removably secure the base pad to the shoulder strap.

3. The removable and adjustable cushioning system of claim 2, wherein the first anchor loop and the second anchor loop are substantially parallel, and the first anchor loop and the second anchor loop each extends in a longitudinal direction with respect to the base pad.

4. The removable and adjustable cushioning system of claim 3, wherein the plurality of anchor loops are arranged in a plurality of rows, with each row of the plurality of rows extending in a lateral direction with respect to the base pad, and the plurality of anchor loops are also arranged in a plurality of columns, with each column of the plurality of columns extending in a longitudinal direction with respect to the base pad.

5. The removable and adjustable cushioning system of claim 4, wherein the retaining strap is a first retaining strap, further comprising:

a third anchor loop that is located in a first column that includes the first anchor loop;

a fourth anchor loop that is located in a second column that includes the second anchor loop, with the fourth anchor loop positioned between the third anchor loop and the base pad neck side; and a second retaining strap that is configured to extend through the third anchor loop, over the upper surface of the shoulder strap, and through the fourth anchor loop to removably secure the base pad to the shoulder strap.

6. The removable and adjustable cushioning system of claim 1, wherein the plurality of fastener receivers are arranged in a plurality of rows, with each row of the plurality of rows extending in a lateral direction with respect to the base pad.

7. A removable and adjustable cushioning system for a shoulder strap, the removable and adjustable cushioning system comprising:

a base pad comprising cushioning material and being contoured to conform to a person's shoulder;

a base shell forming a hard outer covering that is permanently affixed to an upper surface of the base pad;

a plurality of fastener receivers coupled to the base pad via the base shell;

a fastener removably coupled to at least one of the fastener receivers, the fastener configured to engage the shoulder strap to removably secure the base pad to the shoulder strap; and a positioning shell removably and replaceably coupled to the base shell, the positioning shell covering and immediately adjacent to substantially an entire surface of the base shell, the positioning shell having a positioning shell neck side and a positioning shell shoulder side substantially opposite to the positioning shell neck side, the positioning shell including the plurality of fastener receivers.

8. The removable and adjustable cushioning system of claim 7, wherein the plurality of fastener receivers comprises a plurality of receiving slots, the at least one of the fastener receivers comprises a first receiving slot, and the fastener comprises a retaining strap, further comprising:

a second receiving slot positioned between the first receiving slot and the positioning shell neck side, wherein the retaining strap is configured to extend under the positioning shell, upwardly through the first receiving slot and the second receiving slot, and over an upper surface of the shoulder strap to removably secure the positioning shell and the base pad to the shoulder strap.

9. The removable and adjustable cushioning system of claim 8, wherein the first receiving slot and the second receiving slot are substantially parallel and the first receiving slot and the second receiving slot each extends in a longitudinal direction with respect to the positioning shell.

10. The removable and adjustable cushioning system of claim 9, wherein the plurality of receiving slots are arranged in a plurality of rows, with each row of the plurality of rows extending in a lateral direction with respect to the positioning shell, and the plurality of receiving slots are also arranged in a plurality columns, with each column of the plurality of columns extending in a longitudinal direction with respect to the positioning shell.

11. The removable and adjustable cushioning system of claim 10, wherein the retaining strap is a first retaining strap, further comprising:

a third receiving slot that is located in a first column that includes the first receiving slot;

a fourth receiving slot that is located in a second column that includes the second receiving slot, with the fourth receiving slot positioned between the third receiving slot and the positioning shell neck side; and a second retaining strap that is configured to extend under the positioning shell, upwardly through the third receiving slot and the fourth receiving slot, and over the upper surface of the shoulder strap to removably secure the positioning shell and the base pad to the shoulder strap.

12. The removable and adjustable cushioning system of claim 11, wherein the first retaining strap and the second retaining strap each comprises a first end that may be removably affixed to a second end.

13. The removable and adjustable cushioning system of claim 7, wherein the positioning shell includes a positioning shell neck notch formed in the positioning shell neck side, and the base pad includes a base pad neck notch formed in a base pad neck side, the base pad neck notch located substantially adjacent to the positioning shell neck notch.

14. The removable and adjustable cushioning system of claim 7, wherein the plurality of fastener receivers comprises a plurality of apertures in the positioning shell that are distributed about the positioning shell.

15. A removable and adjustable cushioning system for a shoulder strap, the removable and adjustable cushioning system comprising:

a base pad comprising cushioning material and being contoured to conform to a person's shoulder;

a positioning shell removably coupled to the base pad, the positioning shell comprising a row of receiving slots and a position adjustment slot intersecting the receiving slots;

a post having a proximal end that is adjacent to a lower surface of the positioning shell and a distal end that is configured to extend through a first receiving slot in the row of receiving slots and/or through the position adjustment slot, the distal end also configured to protrude through the shoulder strap; and a cap that is removably received by the distal end of the post to removably secure the shoulder strap to the positioning shell and the base pad, whereby the post may be moved from the first receiving slot to a second receiving slot via the position adjustment slot.

16. The removable and adjustable cushioning system of claim 15, wherein the row of receiving slots is a first row of receiving slots, further comprising:

a second row of receiving slots spaced from the first row of receiving slots, the second row of receiving slots comprising a third receiving slot and a fourth receiving slot; and a retaining strap that is configured to extend under the positioning shell, upwardly through the third receiving slot and the fourth receiving slot, and over an upper surface of the shoulder strap to removably secure the positioning shell and the base pad to the the shoulder strap.

17. The removable and adjustable cushioning system of claim 16, wherein the positioning shell includes a positioning shell neck side and a positioning shell shoulder side substantially opposite to the positioning shell neck side, the positioning shell further including a positioning shell neck notch formed in the positioning shell neck side, and the base pad including a base pad neck notch formed in a base pad neck side, the base pad neck notch located substantially adjacent to the positioning shell neck notch.

18. A removable and adjustable cushioning system for a shoulder strap, the removable and adjustable cushioning system comprising:

a base pad comprising cushioning material and being contoured to conform to a person's shoulder;

a plurality of fastener receivers coupled to the base pad;

a fastener removably coupled to at least one of the fastener receivers, the fastener configured to engage the shoulder strap to removably secure the base pad to the shoulder strap; and a positioning shell removably coupled to the base pad, the positioning shell having a positioning shell neck side and a positioning shell shoulder side substantially opposite to the positioning shell neck side, the positioning shell including the plurality of fastener receivers, wherein the fastener comprises a post having a distal end that is configured to extend through one of the fastener receivers and to protrude through the shoulder strap, and further including a cap that is removably received by the distal end of the post, the cap configured to removably secure the shouder strap to the positioning shell and the base pad.

19. A removable and adjustable cushioning system for a shoulder strap, the removable and adjustable cushioning system comprising:

a base pad comprising cushioning material and being contoured to conform to a person's shoulder;

a positioning shell coupled to the base pad, the positioning shell having a positioning shell neck side and a positioning shell shoulder side substantially opposite to the positioning shell neck side;

a first fastening assembly coupled to the positioning shell for engaging the shoulder strap to removably secure the positioning shell and the base pad to the shoulder strap, the first fastening assembly comprising:

a first arm rotatably coupled to the positioning shell, the first arm including a first plurality of hooks;

a first lever rotatably coupled to the positioning shell and spaced from the first arm; and a first bale rotatably coupled to the first lever and configured to be received by one of the first plurality of hooks; and a second fastening assembly coupled to the positioning shell and spaced from the first fastening assembly, the second fastening assembly for engaging the shoulder strap to removably secure the positioning shell and the base pad to the shoulder strap, the second fastening assembly comprising:

a second arm rotatably coupled to the positioning shell, the second arm including a second plurality of hooks;

a second lever rotatably coupled to the positioning shell and spaced from the second arm; and a second bale rotatably coupled to the second lever and configured to be received by one of the second plurality of hooks.

* * * * *